US012533771B2

(12) United States Patent
Chou et al.

(10) Patent No.: US 12,533,771 B2
(45) Date of Patent: Jan. 27, 2026

(54) POLISHING SLURRY DISPENSE NOZZLE

(71) Applicant: Applied Materials, Inc., Santa Clara, CA (US)

(72) Inventors: Chih Chung Chou, San Jose, CA (US); Anand Nilakantan Iyer, Cupertino, CA (US); Ekaterina A. Mikhaylichenko, San Jose, CA (US); Christopher HeungGyun Lee, San Jose, CA (US); Shou-Sung Chang, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 879 days.

(21) Appl. No.: 17/507,704

(22) Filed: Oct. 21, 2021

(65) Prior Publication Data

US 2023/0130235 A1 Apr. 27, 2023

(51) Int. Cl.
*B24B 57/02* (2006.01)
*B24B 37/20* (2012.01)

(52) U.S. Cl.
CPC ..... *B24B 57/02* (2013.01); *B24B 37/20* (2013.01)

(58) Field of Classification Search
CPC ..... B05B 1/06; B05B 1/30; B05B 1/3013; B05B 1/3016; B24B 57/02;
(Continued)

(56) References Cited

U.S. PATENT DOCUMENTS 4,195,810 A * 4/1980 Lavin ..... F16K 7/07 251/5
6,149,508 A * 11/2000 Vanell ..... B24B 51/00 451/72

(Continued)

FOREIGN PATENT DOCUMENTS

CN 102124545 B 11/2013
CN 109702653 A 5/2019

(Continued)

OTHER PUBLICATIONS

International Search Report and Written Opinion mailed on Nov. 2, 2022 in International Patent Application No. PCT/US2022/037086, 12 pages.

(Continued)

*Primary Examiner* — Makena S Markman
(74) *Attorney, Agent, or Firm* — Kilpatrick Townsend & Stockton LLP

(57) ABSTRACT

Exemplary slurry delivery systems may include a slurry source. The systems may include a slurry line coupled with the slurry source. The systems may include a slurry dispensing nozzle. The nozzle may include a lumen having an inlet that is fluidly coupled with a slurry outlet of the slurry line. The nozzle may include a body defining a reservoir and an exit port. The reservoir may be fluidly coupled with a downstream end of the lumen. The exit port may be coupled with the reservoir. The nozzle may include a valve seat. The nozzle may include a valve member having a first surface positioned against the valve seat when in a closed position. The valve member may be movable to an open position in which the first surface is spaced apart from the valve seat. The nozzle may include an actuator coupled with a second surface of the valve member.

16 Claims, 8 Drawing Sheets

(58) Field of Classification Search
CPC ..... H01L 21/6715; B24C 1/08; B24C 3/12; B24C 3/22; B24C 7/0007; B24C 7/0076
USPC ..... 451/60, 446, 36, 99, 101
See application file for complete search history.

(56) References Cited

U.S. PATENT DOCUMENTS

| | | | | |
|---|---|---|---|---|
| 6,551,174 | B1 * | 4/2003 | Brown | B24B 37/04 451/60 |
| 7,086,933 | B2 | 8/2006 | Vereen et al. | |
| 10,948,824 | B2 | 3/2021 | Cheng et al. | |
| 11,772,234 | B2 * | 10/2023 | Tolles | B24B 57/02 451/41 |
| 2003/0103852 | A1 | 6/2003 | Schob | |
| 2005/0272352 | A1 * | 12/2005 | Polyak | B24B 37/042 451/41 |
| 2008/0305725 | A1 * | 12/2008 | Yu | B24B 37/04 451/285 |
| 2017/0128962 | A1 * | 5/2017 | Kashiyama | B05B 3/02 |
| 2018/0047562 | A1 * | 2/2018 | deVilliers | H01L 21/0275 |
| 2019/0148160 | A1 * | 5/2019 | Nangoy | G01F 1/206 438/692 |
| 2020/0102948 | A1 | 4/2020 | Matsuo et al. | |
| 2021/0122008 | A1 | 4/2021 | Tolles et al. | |

FOREIGN PATENT DOCUMENTS

| | | | |
|---|---|---|---|
| JP | 0265555 | U | 5/1990 |
| JP | 2011208786 | A | 10/2011 |
| JP | 2013212452 | A | 10/2013 |
| JP | 2021116907 | A | 8/2021 |
| KR | 200387760 | Y1 | 6/2005 |
| TW | 202116486 | A | 5/2021 |
| WO | 2010051284 | A2 | 5/2010 |

OTHER PUBLICATIONS

Application No. JP2024-522455 , Office Action, Mailed on Apr. 15, 2025, 10 pages.
Application No. TW111129835 , Notice of Decision to Grant, Mailed on Jun. 28, 2024, 4 pages.
Application No. TW111129835 , Office Action, Mailed on Jul. 31, 2023, 16 pages.
Application No. TW111129835 , Office Action, Mailed on Nov. 28, 2023, 8 pages.
Japanese Application No. 2024-522455, Office Action mailed on Aug. 26, 2025, 5 pages (2 pages of English Translation and 3 pages of original document).

* cited by examiner

POLISHING SLURRY DISPENSE NOZZLE

TECHNICAL FIELD

The present technology relates to semiconductor systems, processes, and equipment. More specifically, the present technology relates to the polishing of films deposited on a substrate.

BACKGROUND

An integrated circuit is typically formed on a substrate by the sequential deposition of conductive, semiconductive, and/or insulative layers on a silicon wafer. A variety of fabrication processes use the planarization of a layer on the substrate between processing steps. For example, for certain applications, e.g., polishing of a metal layer to form vias, plugs, and/or lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one common method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. Abrasive polishing slurry is typically supplied to the surface of the polishing pad.

During polishing operations, it is desirable to carefully control the flow (both rate and direction) of slurry, which may help ensure proper distribution of the slurry across the polishing pad and may help reduce the amount of slurry used in the polishing operation. Such control is not provided by conventional CMP systems, which often utilize point dispensing systems to deliver slurry to the polishing pad.

Thus, there is a need for improved systems and methods that can be used to more uniformly polish substrates. These and other needs are addressed by the present technology.

SUMMARY

Exemplary slurry delivery systems may include a slurry source. The systems may include a slurry line having a slurry inlet that is coupled with the slurry source. The systems may include a slurry dispensing nozzle. The slurry dispensing nozzle may include a slurry lumen having an inlet that is fluidly coupled with a slurry outlet of the slurry line. The slurry dispensing nozzle may include a nozzle body defining a slurry reservoir and a nozzle exit port. The slurry reservoir may be fluidly coupled with a downstream end of the slurry lumen. The nozzle exit port may be fluidly coupled with a downstream end of the slurry reservoir. The slurry dispensing nozzle may include a valve seat proximate the nozzle exit port. The slurry dispensing nozzle may include a valve member having a first surface and a second surface opposite the first surface. The first surface may be positioned against the valve seat when the valve member is in a closed position. The valve member may be movable to an open position in which at least a portion of the first surface is spaced apart from the valve seat to selectively open the slurry dispensing nozzle. The slurry dispensing nozzle may include an actuator that is coupled with the second surface of the valve member. Operation of the actuator may cause the valve member to selectively move between the closed position and the open position.

In some embodiments, the actuator may include one or both of a solenoid actuator and a piezoelectric actuator. The systems may include a plunger that is disposed between the actuator and the second surface of the valve member. The plunger may have a proximal end that is coupled with the actuator and a distal end that is coupled with the second surface of the valve member. Operation of the actuator may translate the plunger along a length of the plunger to selectively move the valve member between the closed position and the open position. The systems may include spray tip interfaced with the nozzle exit port. The valve seat may include an angled surface. The first surface of the valve member may have a shape that corresponds with the angled surface of the valve seat. The angled surface may include a rounded dimple. The first surface of the valve member may have a dome shape that corresponds with the rounded dimple. The slurry lumen may include a substantially constant internal diameter. The valve member may isolate the actuator from the slurry reservoir.

Some embodiments of the present technology may encompass slurry dispensing nozzles. The nozzles may include a slurry lumen having an inlet. The nozzles may include a nozzle body defining a slurry reservoir and a nozzle exit port. The slurry reservoir may be fluidly coupled with a downstream end of the slurry lumen. The nozzle exit port may be fluidly coupled with a downstream end of the slurry reservoir. The nozzles may include a valve seat proximate the nozzle exit port. The nozzles may include a valve member having a first surface and a second surface opposite the first surface. The first surface may be positioned against the valve seat when the valve member is in a closed position. The valve member may be movable to an open position in which at least a portion of the first surface is spaced apart from the valve seat to selectively open the slurry dispensing nozzle. The nozzles may include an actuator that is coupled with the second surface of the valve member. Operation of the actuator may cause the valve member to selectively move between the closed position and the open position.

In some embodiments, the valve member may include a diaphragm. The diaphragm may include a generally circular inner region and a generally annular outer region The inner region and the outer region may be coaxial. The inner region may be thicker than the outer region. The nozzles may include a spray tip interfaced with the nozzle exit port. The valve seat and the spray tip may form a monolithic component. The valve seat may include a flange having an outer diameter that is greater than a diameter of the nozzle exit port. The flange may be seated against an inner surface of the nozzle body. The valve seat and the spray tip may be formed from different materials. The spray tip may define a spray aperture having a tapered profile.

Some embodiments of the present technology may encompass methods of polishing a substrate. The methods may include flowing a polishing slurry from a slurry source to a dispensing nozzle. The methods may include delivering the polishing slurry to a polishing pad using the dispensing nozzle. The dispensing nozzle may include a valve member that isolates an actuator of the dispensing nozzle from the polishing slurry. The methods may include polishing a substrate atop the polishing pad.

In some embodiments, the actuator may include a piezoelectric actuator or a solenoid. The polishing slurry may be delivered from the dispensing nozzle via a spray tip. The polishing slurry may be delivered to the polishing pad continuously throughout polishing.

Such technology may provide numerous benefits over conventional systems and techniques. For example, the valve member of the slurry dispensing nozzles described herein may isolate the actuator and other metallic components from the polishing slurry. The nozzles may ensure that only non-reactive materials, such as polymers and/or ceramics, come into contact with the polishing slurry. Additionally, the dispensing nozzles may include simple and/or uniform flow paths that may prevent agglomeration and/or uneven flow of slurry through the dispensing nozzle. These and other embodiments, along with many of their advantages and features, are described in more detail in conjunction with the below description and attached figures.

BRIEF DESCRIPTION OF THE DRAWINGS

A further understanding of the nature and advantages of the disclosed technology may be realized by reference to the remaining portions of the specification and the drawings.

Figure 1:
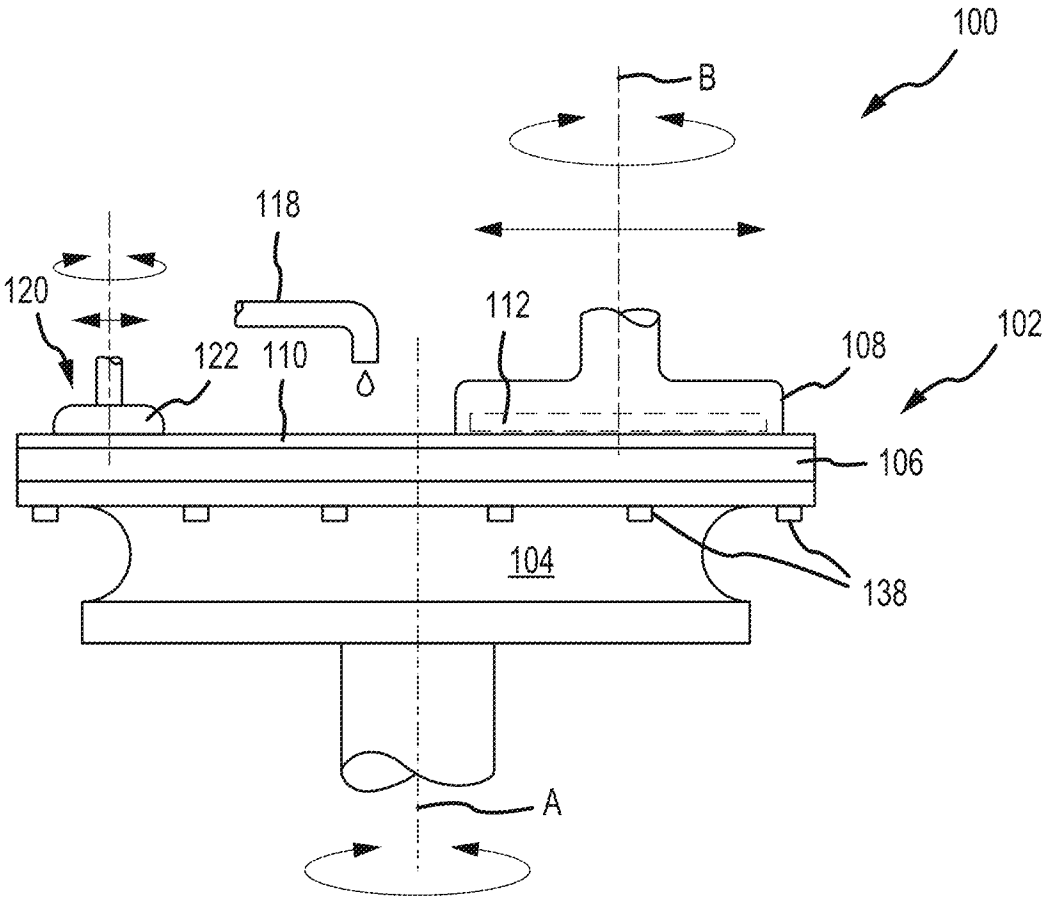
FIG. 1 shows a schematic cross-sectional view of an exemplary polishing system according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the letter.

DETAILED DESCRIPTION

In conventional chemical mechanical polishing (CMP) operations an abrasive slurry is typically delivered to a polishing pad. Abrasive particles within the slurry are used to remove and polish a surface of films deposited on a substrate. The abrasive particles often have sizes that are on the order of tens of nanometers. Conventional CMP systems utilize point dispense systems to deliver the slurry to a platen. However, these point dispense systems deliver the slurry at high rates that contribute to slurry waste as excess slurry flies off of the platen due to high platen speed. Additionally, such point dispense systems provide limited slurry distribution control, which requires the position of the dispense point to get a desired slurry distribution across a polishing pad. Some CMP systems may attempt to address such issues by replacing the point dispense system with a conventional spray nozzle, which may provide a lower slurry flow rate (and result in less slurry waste) and may provide better slurry distribution control by adjusting a position of the nozzle and/or by adjusting a flow rate through the nozzle. However, conventional spray nozzles present their own problems. For example, existing spray nozzles include metallic components within the slurry-wetted path, which may lead to wear of the metallic components and introduce metal particles into the slurry. Additionally conventional spray nozzles often include complex flow paths, which may cause agglomeration issues. Conventional spray nozzles also often include separate spray tips, which may need to be assembled to the nozzle body.

The present technology overcomes these issues with conventional polishing systems and conventional spray nozzles by providing slurry dispensing nozzles that may enable the nozzle position and/or flow rate to be adjusted to carefully control a slurry distribution. The slurry dispensing nozzles may include valve members that isolate actuators and/or other metallic components from the flow of polishing slurry. Additionally, embodiments may provide simple flow paths for the slurry that may prevent agglomeration of abrasive particles and promote uniform flow through the nozzle. Embodiments may also include a modular design, which may enable individual components to be readily removed for cleaning and/or replacement, and may enable many components of the nozzle to be reused when a single component fails.

Although the remaining disclosure will routinely identify specific slurry delivery mechanisms utilizing the disclosed technology, it will be readily understood that the systems and methods are equally applicable to a variety of other semiconductor processing operations and systems. Accordingly, the technology should not be considered to be so limited as for use with the described polishing systems or processes alone. The disclosure will discuss one possible system that can be used with the present technology before describing systems and methods or operations of exemplary process sequences according to some embodiments of the present technology. It is to be understood that the technology is not limited to the equipment described, and processes discussed may be performed in any number of processing chambers and systems, along with any number of modifications, some of which will be noted below.

FIG. 1 shows a schematic cross-sectional view of an exemplary polishing system 100 according to some embodiments of the present technology. Polishing system 100 includes a platen assembly 102, which includes a lower platen 104 and an upper platen 106. Lower platen 104 may define an interior volume or cavity through which connections can be made, as well as in which may be included end-point detection equipment or other sensors or devices, such as eddy current sensors, optical sensors, or other components for monitoring polishing operations or components. For example, and as described further below, fluid couplings may be formed with lines extending through the lower platen 104, and which may access upper platen 106 through a backside of the upper platen. Platen assembly 102 may include a polishing pad 110 mounted on a first surface of the upper platen. A substrate carrier 108, or carrier head, may be disposed above the polishing pad 110 and may face the polishing pad 110. The platen assembly 102 may be rotatable about an axis A, while the substrate carrier 108 may be rotatable about an axis B. The substrate carrier may also be configured to sweep back and forth from an inner radius to an outer radius along the platen assembly, which may, in part, reduce uneven wear of the surface of the polishing pad 110. The polishing system 100 may also include a fluid delivery arm 118 positioned above the polishing pad 110, and which may be used to deliver polishing fluids, such as a polishing slurry, onto the polishing pad 110. Additionally, a pad conditioning assembly 120 may be disposed above the polishing pad 110, and may face the polishing pad 110.

In some embodiments of performing a chemical-mechanical polishing process, the rotating and/or sweeping substrate carrier 108 may exert a downforce against a substrate 112, which is shown in phantom and may be disposed within or coupled with the substrate carrier. The downward force applied may depress a material surface of the substrate 112 against the polishing pad 110 as the polishing pad 110 rotates about a central axis of the platen assembly. The interaction of the substrate 112 against the polishing pad 110 may occur in the presence of one or more polishing fluids delivered by the fluid delivery arm 118. A typical polishing fluid may include a slurry formed of an aqueous solution in which abrasive particles may be suspended. Often, the polishing fluid contains a pH adjuster and other chemically active components, such as an oxidizing agent, which may enable chemical mechanical polishing of the material surface of the substrate 112.

The pad conditioning assembly 120 may be operated to apply a fixed abrasive conditioning disk 122 against the surface of the polishing pad 110, which may be rotated as previously noted. The conditioning disk may be operated against the pad prior to, subsequent, or during polishing of the substrate 112. Conditioning the polishing pad 110 with the conditioning disk 122 may maintain the polishing pad 110 in a desired condition by abrading, rejuvenating, and removing polish byproducts and other debris from the polishing surface of the polishing pad 110. Upper platen 106 may be disposed on a mounting surface of the lower platen 104, and may be coupled with the lower platen 104 using a plurality of fasteners 138, such as extending through an annular flange shaped portion of the lower platen 104.

The polishing platen assembly 102, and thus the upper platen 106, may be suitably sized for any desired polishing system, and may be sized for a substrate of any diameter, including 200 mm, 300 mm, 450 mm, or greater. For example, a polishing platen assembly configured to polish 300 mm diameter substrates, may be characterized by a diameter of more than about 300 mm, such as between about 500 mm and about 1000 mm, or more than about 500 mm. The platen may be adjusted in diameter to accommodate substrates characterized by a larger or smaller diameter, or for a polishing platen 106 sized for concurrent polishing of multiple substrates. The upper platen 106 may be characterized by a thickness of between about 20 mm and about 150 mm, and may be characterized by a thickness of less than or about 100 mm, such as less than or about 80 mm, less than or about 60 mm, less than or about 40 mm, or less. In some embodiments, a ratio of a diameter to a thickness of the polishing platen 106 may be greater than or about 3:1, greater than or about 5:1, greater than or about 10:1, greater than or about 15:1, greater than or about 20:1, greater than or about 25:1, greater than or about 30:1, greater than or about 40:1, greater than or about 50:1, or more.

The upper platen and/or the lower platen may be formed of a suitably rigid, light-weight, and polishing fluid corrosion-resistant material, such as aluminum, an aluminum alloy, or stainless steel, although any number of materials may be used. Polishing pad 110 may be formed of any number of materials, including polymeric materials, such as polyurethane, a polycarbonate, fluoropolymers, polytetrafluoroethylene polyphenylene sulfide, or combinations of any of these or other materials. Additional materials may be or include open or closed cell foamed polymers, elastomers, felt, impregnated felt, plastics, or any other materials that may be compatible with the processing chemistries. It is to be understood that polishing system 100 is included to provide suitable reference to components discussed below, which may be incorporated in system 100, although the description of polishing system 100 is not intended to limit the present technology in any way, as embodiments of the present technology may be incorporated in any number of polishing systems that may benefit from the components and/or capabilities as described further below.

Figure 2:
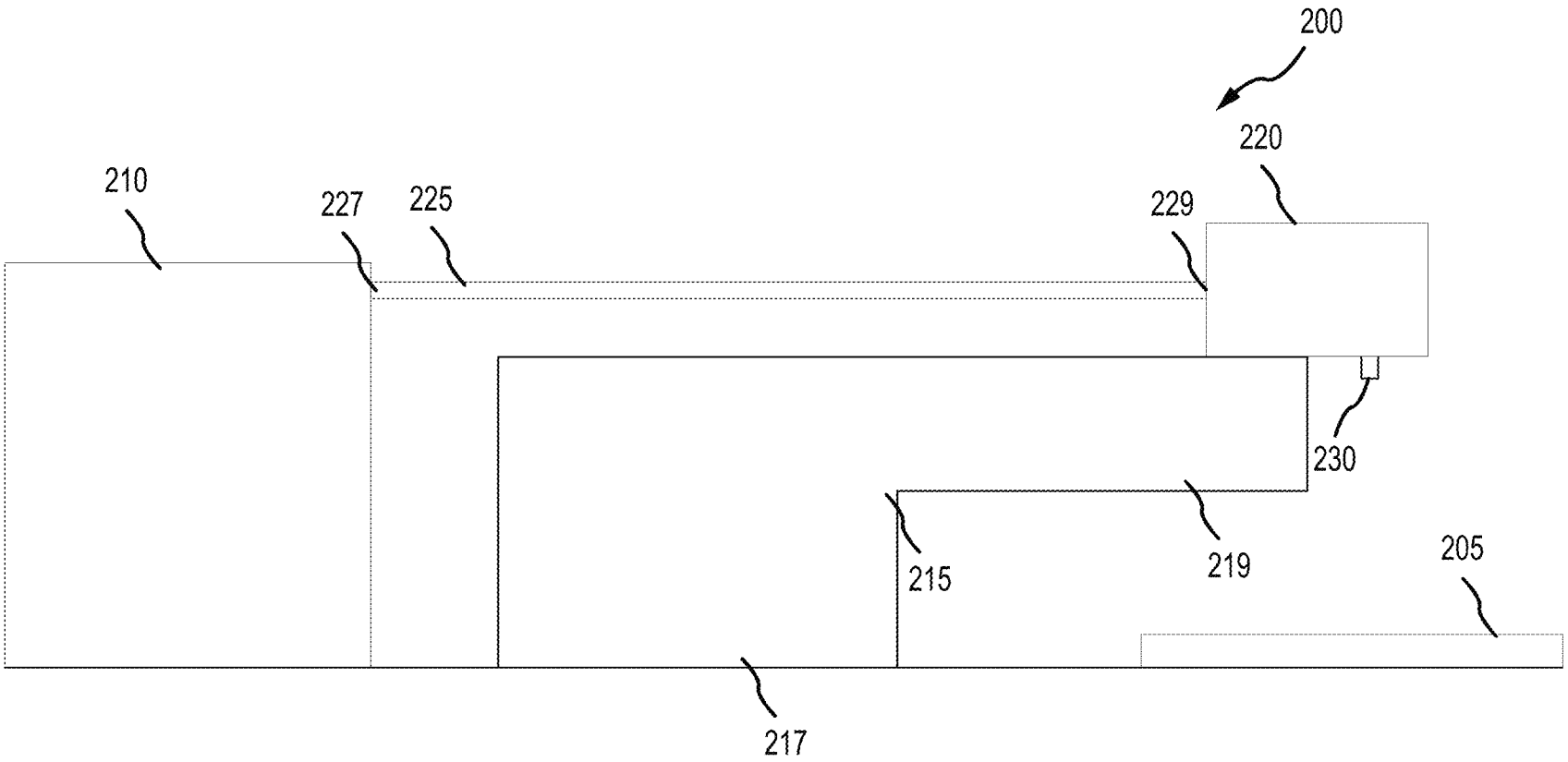
FIG. 2 shows a schematic side elevation view of an exemplary slurry delivery system according to some embodiments of the present technology.

FIG. 2 illustrates a schematic side elevation view of an exemplary slurry delivery system 200 according to some embodiments of the present technology. The system 200 may be used to deliver abrasive polishing slurry to a polishing pad 205, which may be similar to polishing pad 110 in some embodiments. System 200 may show a partial view of the components being discussed and that may be incorporated in a polishing system, similar to polishing system 100. System 200 may include a slurry fluid source 210, which may include a reservoir that holds a volume of polishing slurry. The polishing slurry may include abrasive particles that provide grit that helps the polishing pad 205 to polish the film on the substrate. For example, the slurry may include a nano-sized abrasive powder dispersed in a chemically reactive solution, which may enable the solution to chemically etch and soften the film while the abrasive particles mechanically abrade and/or otherwise remove a portion of the film to planarize and/or otherwise alter a surface of a substrate. The abrasive particles have sizes that are often between about 10 nm and 250 nm, although other sizes of abrasive particles may be used in various embodiments. Slurry fluid source 210 may also include a pump and/or other positive pressure source that may be used to selectively flow the polishing slurry to the polishing pad 205. The polishing slurry may be delivered continuously and/or intermittently during a given polishing operation.

System 200 may include a support arm 215 that may support a dispensing nozzle 220 at a position that is above a portion of the polishing pad 205. For example, a base 217 of the support arm 215 may be positioned radially outward of the polishing pad 205, with an upper portion 219 of the support arm 215 extending outward over a portion of the polishing pad 205 such that a volume of polishing slurry may be delivered to a top surface of the polishing pad 205 via a spray tip 230. The delivery nozzle 220 may include an actuator and valve assembly that may be selectively opened and closed to dispense a desired quantity of slurry to the polishing pad 205. A slurry line 225 may extend between the slurry fluid source 210 and the dispensing nozzle 220. For example, a slurry inlet 227 of the slurry line 225 may be coupled with the slurry source 210 and a slurry outlet 229 of the slurry line 225 may be coupled with an inlet of the dispensing nozzle 220.

Figure 3:
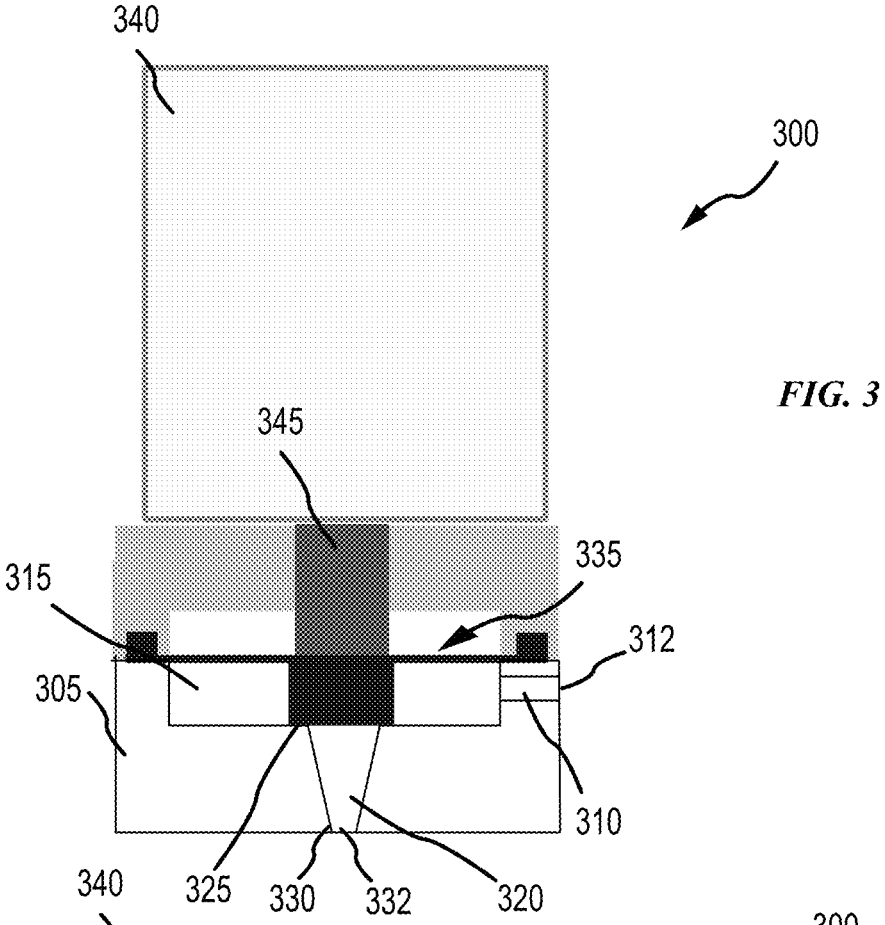
FIG. 3 shows a schematic partial cross-sectional view of an exemplary slurry dispensing nozzle in a closed position according to some embodiments of the present technology.

FIG. 3 illustrates a schematic cross-sectional view of an exemplary slurry dispensing nozzle 300 according to some embodiments of the present technology. FIG. 3 may illustrate further details relating to components in system 200, such as for dispensing nozzle 220. Dispensing nozzle 300 is understood to include any feature or aspect of dispensing nozzle 220 discussed previously in some embodiments. The dispensing nozzle 300 may be used to deliver abrasive polishing slurry to a polishing pad, such as polishing pads 110 and 205 described herein. Dispensing nozzle 300 may show a partial view of the components being discussed and that may be incorporated in a polishing system, similar to polishing system 100 and/or system 200. Dispensing nozzle 300 may include a nozzle body 305, which may be formed from and/or be coated with a non-reactive and non-metallic material. For example, the nozzle body 305 may be formed from polyvinylidene fluoride (PVDF), polytetrafluoroethylene (PTFE), polyether ether ketone (PEEK), polyethylene terephthalate (PET), polyphenylene sulfide (PPS), a ceramic, and/or other material. The nozzle body 305 may define a slurry lumen 310 and a slurry reservoir 315. The slurry lumen 310 may extend through an outer surface of the nozzle body 305 and may be fluidly coupled with the slurry reservoir 315. The slurry lumen 310 may include an inlet 312 that may be coupled with a slurry outlet of a slurry line, such as slurry outlet 229 of slurry line 225, to fluidly couple the dispensing nozzle 300 with a slurry fluid source, such as slurry fluid source 210. The inlet 312 may extend through a rear, a side, and/or a front surface of the nozzle body 305 in various embodiments.

The slurry lumen 310 may form a simple, substantially uniform flow path for slurry flowing into the slurry reservoir 315. For example, in some embodiments, the slurry lumen 310 may include no or very few turns, which may simplify the fluid path. Any corners present in the slurry lumen 310 may be rounded, which may help facilitate uniform flow through the slurry lumen 310, such as by reducing and/or eliminating sharp corners that may otherwise produce eddies and/or other forms of turbulent flow through the fluid lumen 310. Additionally, a cross-section/internal diameter of the slurry lumen 310 may be substantially constant (e.g., with the cross-section having a diameter that remains within or about 10% of an average diameter at all points, within or about 5%, within or about 2.5%, within or about 1%, or less) along a length of the slurry lumen 310. A downstream end of the slurry lumen 310 may be coupled with the slurry reservoir 315. For example, the downstream end of the slurry lumen 310 may be coupled with a front, rear, and/or side of the slurry reservoir 315. In some embodiments, the slurry lumen 310 may be completely aligned with at least a portion of the slurry reservoir 315. In other embodiments, a portion of the slurry lumen 310 may be offset from the slurry reservoir 315 such that the slurry lumen 310 and/or slurry reservoir 315 includes a bend to direct slurry into a main region of the slurry reservoir 315. Corners of the slurry lumen 310 and/or slurry reservoir 315 at the bend may be rounded to improve flow uniformity through the dispensing nozzle 300.

As illustrated in FIG. 3, the inlet 312 of the slurry lumen 310 extends through a side surface of the nozzle body 305 and forms a linear fluid path to a side of the slurry reservoir 315. The slurry lumen 310 has a substantially constant cross-section. Other embodiments may include other arrangements of slurry lumens. For example, as illustrated in an alternative embodiment of a dispensing nozzle 300*b* shown in FIG. 3B, an inlet 312*b* of a slurry lumen 310*b* extends through a rear surface of a nozzle body 305*b*. The fluid lumen 310*b* bends such that a downstream end of slurry lumen 310*b* couples with a side of a fluid reservoir 315*b*. The slurry lumen 310*b* has a substantially constant cross-section. For example, a radius of curvature of the bend may be selected such that the slurry lumen 310*b* maintains a substantially constant cross-section even through the bend. It will be appreciated that the arrangements of slurry lumens described above are merely included as examples, and that numerous designs of slurry lumens may be used in various embodiments.

Turning back to FIG. 3, the nozzle body 305 may define a nozzle exit port 320 that has a proximal end that is fluidly coupled with a downstream of the slurry reservoir 315. The nozzle exit port 320 may extend from the slurry reservoir 315 where a distal end of the nozzle exit port 320 extends through an outer surface of the nozzle body 305 and provides an opening through which slurry may be dispensed from the dispensing nozzle 300. While shown with nozzle exit port 320 extending through a front surface of the nozzle body 305, it will be appreciated that the nozzle exit port 320 may extend through a rear surface and/or side surface of the nozzle body 305 in various embodiments. A valve seat 325 may be disposed proximate the valve exit port 320. For example, the valve seat 325 may be formed in or positioned at the proximate side of the nozzle exit port 320. In some embodiments, the valve seat 325 may be part of the nozzle body 305, while in other embodiments the valve seat 325 may be a separate component that is coupled with the nozzle body 305.

The dispensing nozzle 300 may include a spray tip 330 that may be interfaced with the nozzle exit port 320. The spray tip 330 may be formed as part of the nozzle body 305 and/or may be a separate component. For example, the spray tip 330 may be inserted and/or otherwise coupled with the nozzle exit port 320 in various embodiments. The spray tip 330 may define a spray aperture 332 that is sized and shaped to deliver a desired spray pattern of slurry to a polishing pad of a substrate polishing system. In some embodiments, the spray aperture 332 may be generally cylindrical in shape, while in other embodiments, such as shown in FIG. 3, the spray aperture 332 may have a tapered profile. For example, the spray aperture 332 may have a generally conical profile and/or a more complex tapered profile. The contour of the spray aperture 332 may include one or more linear tapers and/or one or more curved tapers in various embodiments.

Figure 3A:
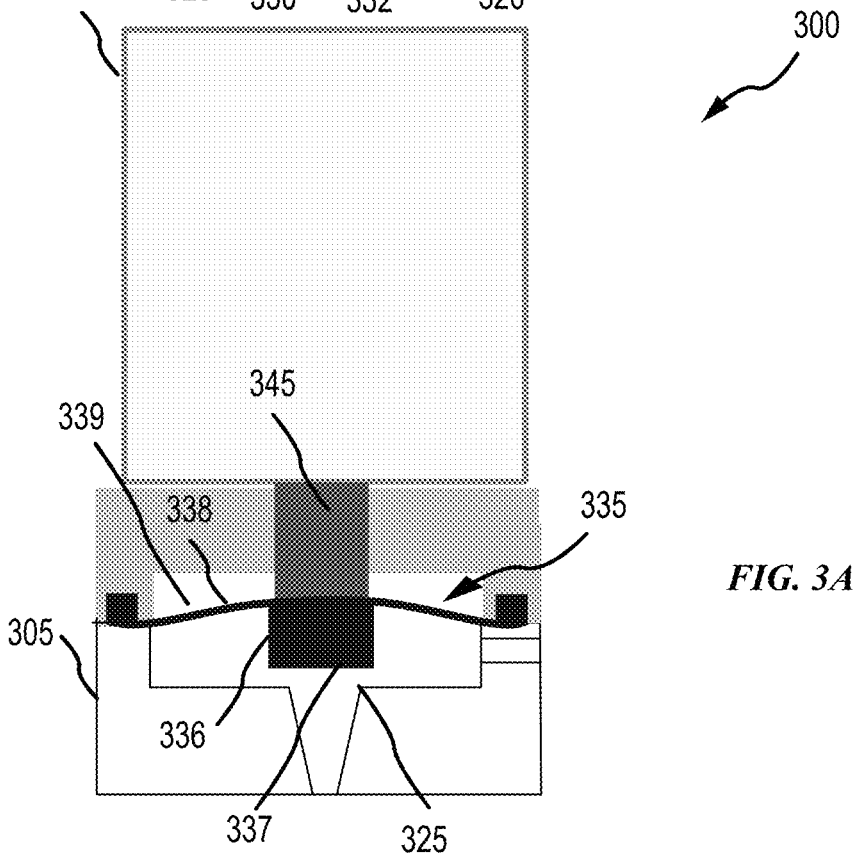
FIG. 3A shows a schematic partial cross-sectional view of the slurry dispensing nozzle of FIG. 3 in an open position according to some embodiments of the present technology.
Figure 3B:
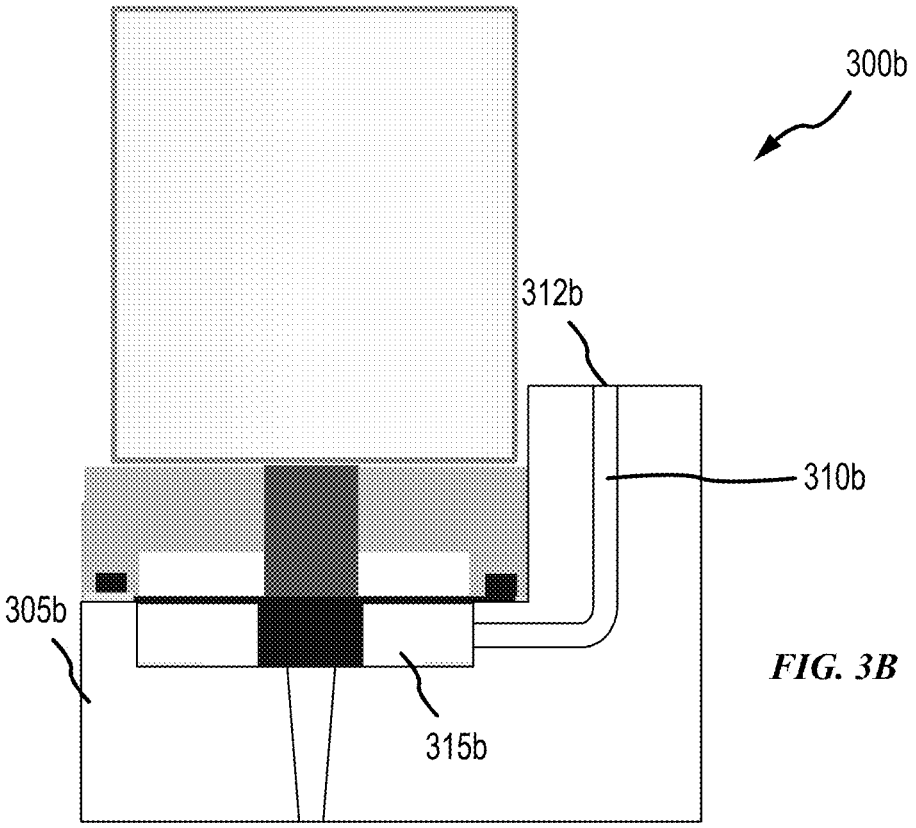
FIGS. 3B-3F show schematic partial cross-sectional views of the slurry delivery assembly of FIG. 3 with various valve seat and spray tip configurations according to some embodiments of the present technology.
Figure 3C:
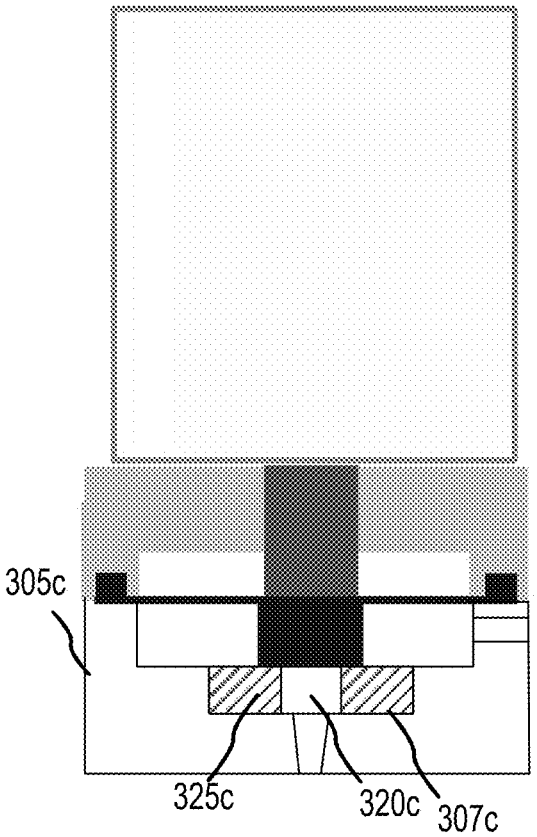
Figure 3D:
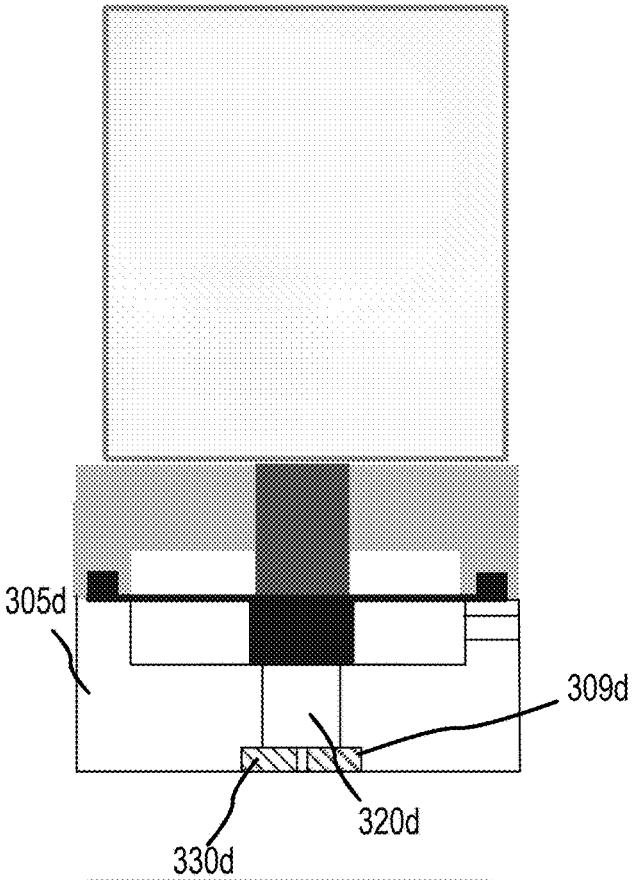
Figure 3E:
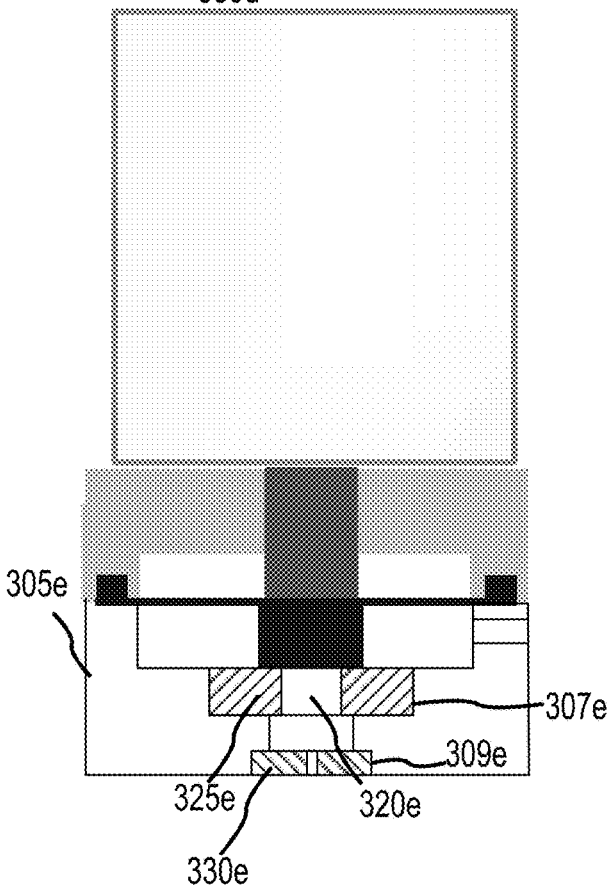
Figure 3F:
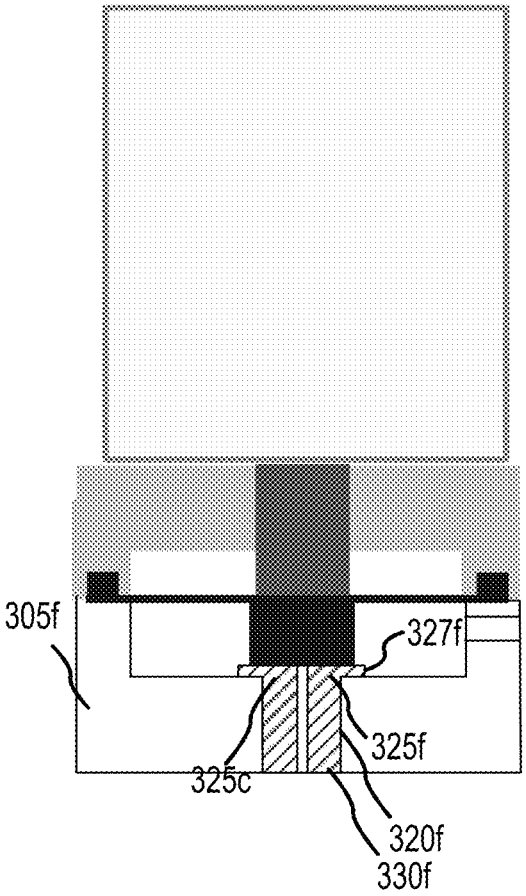

The valve seat 325 and/or spray tip 330 may be provided in various forms. For example, as illustrated in FIG. 3, the valve seat 325 and spray tip 330 are machined into and/or otherwise formed in the nozzle body 305 such that the valve seat 325, spray tip 330, and nozzle body 305 form a monolithic structure. In other embodiments, the valve seat 325 and/or spray tip 330 may be separate components that are inserted into and/or otherwise coupled with the nozzle body 305. For example, as illustrated in FIG. 3C, the nozzle body 305*c* defines a recess 307*c* near the proximal end of the nozzle exit port 320*c*, with the valve seat 325*c* being a separate annular component inserted within the recess 307*c*. As illustrated in FIG. 3D, the nozzle body 305*d* defines a recess 309*d* near the distal end of the nozzle exit port 320*d*, with the spray tip 330*d* being a separate annular component inserted within the recess 309*d*. As illustrated in FIG. 3E, the nozzle body 305*e* defines a recess 307*e* near the proximal end of the nozzle exit port 320*e*, with the valve seat 325*e* being a separate annular component inserted within the recess 307*e*. The nozzle body 305*e* also defines a recess 309*e* near the distal end of the nozzle exit port 320*e*, with the spray tip 330*e* being a separate annular component inserted within the recess 309*e*. In yet other embodiments, the valve seat 325 and spray tip 330 may be a single component that is interfaced and/or otherwise coupled with the nozzle body 305. For example, as illustrated in FIG. 3F, the valve seat 325*f* and spray tip 330*f* may form a monolithic component. The valve seat end may include a flange 327*f*, which may have an outer diameter that is greater than a diameter of the nozzle exit port 320*f*. The valve seat 325*f* and spray tip 330*f* may be inserted through the proximal end of the nozzle exit port 320*f* until the flange 327*f* is seated against an inner surface of the nozzle body 305*f* (such as abutting the proximal end of the nozzle exit port 320*f*) and the spray tip 330*f* is proximate the distal end of the nozzle exit port 320*f*. By inserting the valve seat 325*f* and spray tip 330*f* from the proximal end of the nozzle exit port 320*f*, the flow of slurry through the spray tip 330*f* may help maintain the valve seat 325*f* and spray tip 330*f* in position within the nozzle exit port 320*f*, possibly without the use of adhesives and/or fastening mechanisms in some embodiments.

The use of a separate valve seat 325 and/or spray tip 330 may enable the valve seat 325 and/or spray tip 330 to be formed of different materials from the nozzle body 305 that may be more suitable for the functionality of the valve seat 325 and/or spray tip 330. For example, the valve seat 325 may be formed of a non-reactive material (such as a polymer) that may be particularly smooth so as to enable a liquid-tight and/or airtight sealing surface. In some embodiments, the valve seat 325 may be formed from and/or coated with a polymer, such as Teflon and/or PEEK, although other polymeric materials are usable in some embodiments. The spray tip 330 may be formed of a material that promotes low friction flow of slurry therethrough. In some embodiments, the spray tip 330 may be formed from a material that is resistant to wear, which may increase the service life of the spray tip 330, as non-wear resistant materials may degrade due to the flow of abrasive slurry through the spray aperture 332. The degradation of the spray aperture 332 may alter the size and/or shape of the spray aperture 332, which may change the flow rate, spray pattern, and/or other spray characteristics through the dispensing nozzle 300. In some embodiments, the spray tip 330 may be formed from and/or coated with Teflon, PEEK, a ceramic material (such as aluminum oxide), and/or other material. In some embodiments, the valve seat 325 and spray tip 330 may be made of the same material while in other embodiments, the valve seat 325 and spray tip 330 may be made of different materials. Additionally, by providing the valve seat 325 and/or spray tip 330 as separate components, the valve seat 325 and/or spray tip 330 may be easily removed from the nozzle body 305 for replacement and/or cleaning of the parts. This may enable a nozzle body 305 to be reused even if the valve seat 325 and/or spray tip 330 is damaged, dirty, or worn out.

Turning back to FIG. 3, the dispensing nozzle 300 may include a valve member 335 that may be used to selectively open and close the dispensing nozzle 300 to dispense a volume of slurry. The valve member 335 may be characterized by a first surface 337 and a second surface 339 opposite the first surface 337. The first surface 337 may be positioned against a sealing surface of the valve seat 325 when the valve member 335 is in a closed position as shown in FIG. 3. The valve member 335 may be movable to an open position in which at least a portion of the first surface 337 is spaced apart from the sealing surface of the valve seat 325 as shown in FIG. 3A. When in the open position, the valve member 335 may enable slurry to be dispensed from the dispensing nozzle 300.

In some embodiments, the valve member 335 may be in the form of a diaphragm. The diaphragm may include an inner region 336 and an outer region 338. For example, the inner region 336 may be generally circular in shape and may be surrounded by a generally annular outer region 338, with the inner region 336 and the outer region 338 being coaxial in some embodiments. In some embodiments, the inner region 336 may be positioned against the sealing surface of the valve seat 325 in the closed position and may be spaced apart from the sealing surface of the valve seat 325 in the open position. The inner region 336 may be thicker than the outer region 338 in some embodiments, which may enable the outer region 338 to be more flexible to enable the valve member 335 to flex to open the dispensing nozzle 300. The transition between the inner region 336 and outer region 338 may be stepped as shown and/or may be gradually contoured.

Figure 3G:
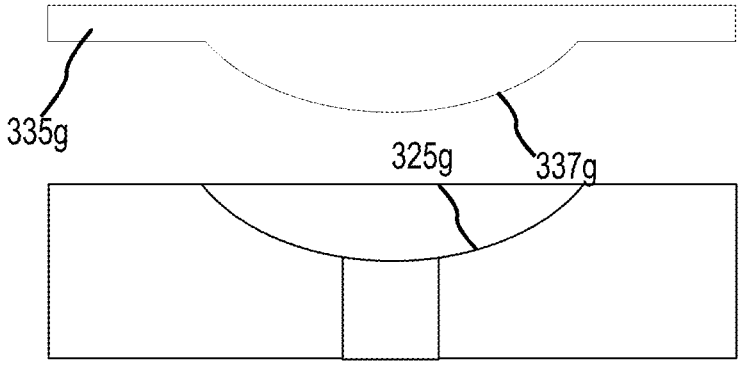
FIGS. 3G and 3H show schematic partial cross-sectional views of the slurry dispensing nozzle of FIG. 3 with various valve member and valve seat configurations according to some embodiments of the present technology.
Figure 3H:
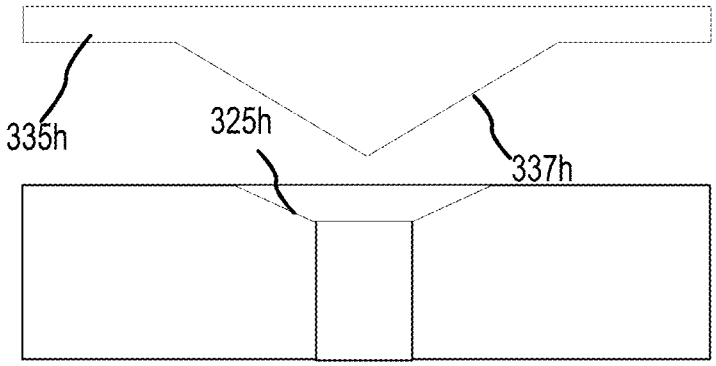

Dispensing nozzle 300 may utilize different shapes of sealing surfaces of valve seat 325 and first surface of valve member 335 in various embodiments. For example, as illustrated in FIG. 3, the sealing surface of valve seat 325 and first surface 337 of valve member 335 may be generally planar. In other embodiments, the sealing surface of valve seat 325 and valve member 335 may be non-planar. For example, as illustrated in FIG. 3G the sealing surface of valve seat 325*g* may have rounded dimple shape, while the first surface 337*g* of valve member 335*g* may be generally dome shaped, with the dome shape having a size and/or contour that corresponds to the contour of the rounded dimple shape. In other embodiments, such as illustrated in FIG. 311, the sealing surface of valve seat 325*h* may have an angled surface, such as a generally conical profile. The first surface 337*h* of valve member 335*h* may have a tapered shape that corresponds with the angled sealing surface of valve seat 325*h*. For example, the first surface 337*h* of valve member 335*h* may have a generally conical shape. As noted above, the transition between inner regions and outer regions of the various valve members 335 may be stepped and/or may be gradually contoured. It will be appreciated that other shapes of sealing surfaces of valve seats and first surfaces of valve members may be used that effectively seal the dispensing nozzle 300 when closed in various embodiments.

Dispensing nozzle 300 may include an actuator 340, such as a linear actuator, which may be coupled with the nozzle body 305. For example, the actuator 340 may be coupled with a rear surface of the nozzle body 305. The valve member 335 may isolate the actuator 340 from the slurry reservoir 315 such that no slurry can contact any portion of the actuator 340. For example, the slurry may be maintained on a first surface side of the valve member 335, while all components of the dispensing nozzle 300 on the second surface side of the valve member 335 (and the second surface 339 itself) are isolated from the slurry. The actuator 340 may be coupled with the second surface 339 of the valve member 335 such that operation of the actuator 340 may cause the valve member 335 to selectively move between the closed position and the open position. The actuator 340 may be directly coupled with the second surface 339 of the valve member 335 and/or dispensing nozzle 300 may include one or more intervening components. For example, a plunger 345 may be disposed between the actuator 340 and the second surface 339 of the valve member 335. The plunger 345 may include a proximal end that is coupled with the actuator 340 and a distal end that is coupled with the second surface 339 of the valve member 335. Operation of the actuator 340 may cause the plunger 345 to translate along a length of the plunger 345 to selectively move the valve member 335 between the open and closed position.

As noted above, the actuator 340 may be a linear actuator that may move the valve member 335 between the open and closed positions. In some embodiments, the actuator 340 may include a solenoid. For example, the solenoid may receive an electric current that generates a magnetic field that pulls and/or otherwise moves the plunger 345 (which may include a ferromagnetic material) away from the valve seat 325 to open the dispensing nozzle 300 to enable slurry to be dispensed. In other embodiments, the actuator 340 may include a piezoelectric actuator. For example, an electric current may be applied to one or more piezoelectric elements, which may cause the piezoelectric elements to expand and/or contract. The expansion and contraction of the piezoelectric elements may cause the valve member 335 to be selectively moved between the open and closed positions. It will be appreciated that other forms of linear actuators may be utilized in various embodiments.

By isolating the actuator and/or other metallic components from the flow of polishing slurry, wear of metal components and metal particulate within the slurry may be eliminated, which may increase the service life of the nozzle and may improve the performance of polishing operations. Additionally, embodiments may provide simple flow paths for the slurry that may prevent agglomeration of abrasive particles and promote uniform flow through the nozzle.

In some embodiments, the dispensing nozzle 300 may be constructed in a modular fashion. For example, the actuator 340, plunger 345, valve member 335, valve seat 325, and/or spray tip 330 may be decoupled from the nozzle body 305. For example, the actuator 340 may be removed from the nozzle body 305, which may enable the plunger 345, valve member 335, valve seat 325, and/or spray tip 330 to be accessed and/or removed. The modular design may enable individual components of the dispensing nozzle 300 to be replaced individually, while enabling the rest of the components of the dispensing nozzle 300 to remain in use. This may be particularly useful for components that may experience wear from the flowing slurry, such as the valve member 335, the valve seat 325, and/or spray tip 330.

Figure 4:
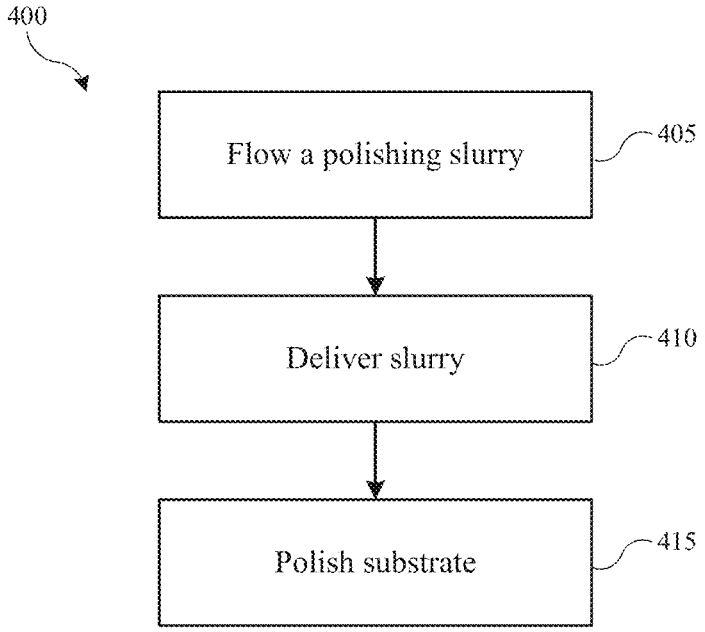
FIG. 4 is a flowchart of an exemplary method of polishing a substrate according to some embodiments of the present technology.

FIG. 4 shows exemplary operations in a method 400 for polishing a substrate according to some embodiments of the present technology. Method 400 may be performed using a slurry delivery assembly having a slurry dispensing nozzle, such as slurry delivery system 200 and/or slurry dispensing nozzles 220 and 300 described herein. Method 400 may include operations prior to the substrate polishing in some embodiments. For example, prior to the polishing, a substrate may have one or more deposition and/or etching operations performed as well as any planarization or other process operations performed. Method 400 may include a number of operations that may be performed automatically within a system to limit manual interaction, and to provide increased efficiency and precision over manual operations. Method 400 may be performed in conjunction with a conventional CMP polishing process.

Method 400 may include flowing a polishing slurry to a dispensing nozzle at operation 405. Method 400 may include delivering the polishing slurry to a polishing pad using the dispensing nozzle at operation 410. For example, the polishing slurry may be flowed through dispensing nozzle that expels the polishing slurry on a top surface of the polishing pad. The slurry may be delivered via a spray tip that controls a flow rate and/or spray pattern of slurry emitted from the dispensing nozzle. The polishing slurry may be delivered to polishing pad continuously and/or periodically during the polishing operation. The dispensing nozzle may be similar to dispensing nozzles 220 and 300 described herein, and may include a slurry lumen, slurry reservoir, and nozzle exit port 320 that are fluidly isolated from an actuator (and other metallic components) using a valve member.

At operation 415, a substrate atop the polishing pad may be polished. For example, the substrate may be positioned face (film side) down on a carrier, which may rotate and/or laterally translate the face of the substrate against the polishing pad. The chemical solution of the slurry may chemically etch and soften the film while the abrasive particles mechanically abrade and/or otherwise remove a portion of the film to planarize and/or otherwise alter a surface of the substrate.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Thus, for example, reference to "a heater" includes a plurality of such heaters, and reference to "the protrusion" includes reference to one or more protrusions and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. A slurry delivery system, comprising:
a polishing pad;
a slurry source;
a slurry line having a slurry inlet that is coupled with the slurry source; and
a slurry dispensing nozzle that is disposed above a portion of the polishing pad and is operable to deliver a volume of slurry to the polishing pad, the slurry dispensing nozzle comprising:
a slurry lumen having an inlet that is fluidly coupled with a slurry outlet of the slurry line;
a nozzle body defining a slurry reservoir and a nozzle exit port, wherein:
the inlet of the slurry lumen extends through a side surface of nozzle body;
the slurry reservoir is fluidly coupled with a downstream end of the slurry lumen; and
the nozzle exit port is fluidly coupled with a downstream end of the slurry reservoir;
a valve seat proximate the nozzle exit port;
a valve member having a first surface and a second surface opposite the first surface, wherein:
the first surface is positioned against the valve seat when the valve member is in a closed position; and
the valve member is movable to an open position in which at least a portion of the first surface is spaced apart from the valve seat to selectively open the slurry dispensing nozzle; and
an actuator that is coupled with the second surface of the valve member, wherein operation of the actuator causes the valve member to selectively move between the closed position and the open position.

2. The slurry delivery system of claim 1, wherein:
the actuator comprises one or both of a solenoid actuator and a piezoelectric actuator.

3. The slurry delivery system of claim 1, further comprising:
a plunger that is disposed between the actuator and the second surface of the valve member, the plunger having a proximal end that is coupled with the actuator and a distal end that is coupled with the second surface of the valve member, wherein operation of the actuator translates the plunger along a length of the plunger to selectively move the valve member between the closed position and the open position.

4. The slurry delivery system of claim 1, further comprising:
a spray tip interfaced with the nozzle exit port.

5. The slurry delivery system of claim 1, wherein:
the valve seat comprises an angled surface; and
the first surface of the valve member has a shape that corresponds with the angled surface of the valve seat.

6. The slurry delivery system of claim 5, wherein:
the angled surface comprises a rounded dimple; and
the first surface of the valve member has a dome shape that corresponds with the rounded dimple.

7. The slurry delivery system of claim 1, wherein:
the slurry lumen comprises a substantially constant internal diameter.

8. The slurry delivery system of claim 1, wherein:
the valve member isolates the actuator from the slurry reservoir.

9. A slurry dispensing nozzle, comprising:
a slurry lumen having an inlet that is configured to be coupled with a downstream end of a slurry delivery line;
a nozzle body defining a slurry reservoir and a nozzle exit port, wherein:
the inlet of the slurry lumen extends through a side surface of nozzle body;
the slurry reservoir is fluidly coupled with a downstream end of the slurry lumen; and
the nozzle exit port is fluidly coupled with a downstream end of the slurry reservoir;
a valve seat proximate the nozzle exit port;
a valve member having a first surface and a second surface opposite the first surface, wherein:
the first surface is positioned against the valve seat when the valve member is in a closed position; and
the valve member is movable to an open position in which at least a portion of the first surface is spaced apart from the valve seat to selectively open the slurry dispensing nozzle; and
an actuator that is coupled with the second surface of the valve member, wherein operation of the actuator causes the valve member to selectively move between the closed position and the open position.

10. The slurry dispensing nozzle of claim 9, wherein:
the valve member comprises a diaphragm.

11. The slurry dispensing nozzle of claim 10, wherein:
the diaphragm comprises a generally circular inner region and a generally annular outer region;
the inner region and the outer region are coaxial; and
the inner region is thicker than the outer region.

12. The slurry dispensing nozzle of claim 9, further comprising:
a spray tip interfaced with the nozzle exit port.

13. The slurry dispensing nozzle of claim 12, wherein:
the valve seat and the spray tip form a monolithic component.

14. The slurry dispensing nozzle of claim 13, wherein:
the valve seat comprises a flange having an outer diameter that is greater than a diameter of the nozzle exit port; and
the flange is seated against an inner surface of the nozzle body.

15. The slurry dispensing nozzle of claim 12, wherein:
the valve seat and the spray tip are formed from different materials.

16. The slurry dispensing valve of claim 12, wherein:
the spray tip defines a spray aperture having a tapered profile.

* * * * *